United States Patent [19]

Ryer et al.

[11] 4,369,118

[45] Jan. 18, 1983

[54] PROCESS OF INHIBITING HAZE IN LUBRICATING OIL COMPOSITIONS

[75] Inventors: Jack Ryer, East Brunswick; Ricardo Bloch, Scotch Plains, both of N.J.

[73] Assignee: Exxon Research & Engineering Co., Florham Park, N.J.

[21] Appl. No.: 220,457

[22] Filed: Dec. 29, 1980

[51] Int. Cl.[3] ..... C10M 1/32

[52] U.S. Cl. ..... 252/39; 252/51.5 R

[58] Field of Search ..... 252/39, 51.5 R; 585/12

[56] References Cited

U.S. PATENT DOCUMENTS

| | | | |
|---|---|---|---|
| 3,093,585 | 6/1963 | Low et al. | 252/51.5 R |
| 3,412,029 | 11/1968 | Andress, Jr. et al. | 252/51.5 R |
| 3,632,511 | 1/1972 | Liao | 252/51.5 A |
| 3,655,560 | 4/1972 | Andress, Jr. | 252/51.5 R X |
| 3,679,428 | 7/1972 | Shiba et al. | 96/124 |
| 3,738,992 | 6/1973 | Frump | 252/51.5 A X |
| 3,790,483 | 2/1974 | Song et al. | 585/12 X |
| 3,843,536 | 10/1974 | Johnston | 252/51.5 R |
| 3,843,726 | 10/1974 | Cobb | 260/570.55 |
| 3,907,745 | 9/1975 | Bsharah et al. | 252/51.5 R X |
| 4,017,406 | 4/1977 | Brois et al. | 252/51.5 A |
| 4,049,564 | 9/1977 | Ryer et al. | 252/51.5 A |
| 4,062,786 | 12/1977 | Brois et al. | 252/51.5 R |
| 4,067,288 | 12/1977 | Brois et al. | 252/51.5 R |
| 4,069,162 | 1/1978 | Gardiner et al. | 252/32.7 E |
| 4,070,370 | 1/1978 | Elliott et al. | 260/326.25 |
| 4,176,075 | 11/1979 | Alexander et al. | 252/51.5 R X |
| 4,282,108 | 8/1981 | Deen et al. | 252/51.5 R |

FOREIGN PATENT DOCUMENTS

| | | | |
|---|---|---|---|
| 2543791 | 4/1976 | Fed. Rep. of Germany | 252/51.5 R |
| 564506 | 10/1944 | United Kingdom . | |
| 809001 | 2/1959 | United Kingdom . | |
| 984409 | 2/1965 | United Kingdom . | |

OTHER PUBLICATIONS

U.S. Serial 110,004.

"Chemistry and Use of Aminohydroxy Compounds", Commercial Solvents Corp., N.Y.

Senkus, "J.A.C.S.", 67, p. 1515, 1945.

Bergmann, "Chem. Rev.", 53, p. 309, 1953.

Hancock et al., "J.A.C.S.", 66, p. 1747, 1944.

*Primary Examiner*—Andrew Metz

*Attorney, Agent, or Firm*—Frank T. Johmann

[57] ABSTRACT

Oil compositions comprising a lubricating oil and an oil-soluble hydrocarbon polymeric viscosity index improver such as ethylene-propylene copolymers which contain an antihazing amount of an oil-soluble metal chelating compound having a nitrogen atom and a hydroxy group separated by 2 or 3 carbons and containing a total of 5 to 50 carbon atoms. The invention also relates to the process for preparing said compositions.

5 Claims, No Drawings

PROCESS OF INHIBITING HAZE IN LUBRICATING OIL COMPOSITIONS

BACKGROUND OF THE INVENTION

1. Field of the Invention

This invention relates to haze inhibited lubricating oil compositions having an improved viscosity index resulting from the presence of a hydrocarbon polymeric viscosity index improver as well as to the haze-inhibited additive concentrates by means of which said lubricating oil compositions are formulated. In particular, this invention is directed to haze-free lubricating oil compositions and additive packages used in formulating them, and methods for their preparation, containing hydrocarbon polymers, particularly ethylene-propylene copolymer viscosity index improvers. In its preferred form, the invention is directed to hydrocarbon polymers produced by processes resulting in oil insoluble metal containing contaminants which normally impart haze to the oil composition and a haze inhibiting amount of an oil soluble compound which chelates and solubilizes said metal containing haze component.

The problem of haze in oil solutions due to metal contaminants resulting from the preparation of polymers for use as viscosity index improvers is discussed in U.S. Pat. No. 4,069,162 which teaches the addition of oil soluble strong acids, e.g. an alkaryl sulfonic acid, to inhibit such haze.

U.S. Patent application Ser. No. 110,004 now U.S. Pat. No. 4,282,108 to Harold E. Deen et al teaches various oxazolidines resulting from the reaction of cyclic ketone and amino alcohol as oil additives and as chelating agents for functional fluids, including lubricating oils and synthetic lubricants.

SUMMARY OF THE INVENTION

A variety of metal catalysts, or fragments thereof, metal salts of weak acid, e.g. calcium stearate, etc. which result as by-products of the polymerization, finishing process or other steps in the manufacture of hydrocarbon polymers for use in oil, e.g. ethylene-containing copolymers or their oil concentrates, can cause haze in lubricating oil compositions prepared from said ethylene copolymers. These haze problems due to metal-containing contaminants can be overcome by treating the hydrocarbon polymer, or its oil concentrate which generally comprises a hydrocarbon solvent and from 0.1 to 50, preferably 5 to 30 wt. % based upon said solution, of a soluble hydrocarbon polymeric material having viscosity index improving characteristics, with the oil solubilizing metal chelating compounds of the invention.

DESCRIPTION OF PREFERRED EMBODIMENT

Viscosity Index Improving Polymers

Oil soluble hydrocarbon polymeric viscosity index improver oil compositions containing oil insoluble metal contaminants are contemplated to be processed in accordance with this invention whereby said compositions are made substantially haze free. These V.I. improving polymers generally have a number average molecular weight ($\overline{M}_n$) of from about 5000 to about 500,000 preferably 10,000 to 200,000 and optimally from about 20,000 to 100,000. In general, hydrocarbon polymers having a narrow range of molecular weight, as determined by the ratio of weight average molecular weight ($\overline{M}_w$) to number average molecular weight ($\overline{M}_n$) are preferred. Polymers having a $\overline{M}_w/\overline{M}_n$ of less than 10, preferably less than 7, and most preferably 4 are most desirable. As used herein ($\overline{M}_n$) and ($\overline{M}_w$) are measured by the well known techniques of vapor phase osmometry (VPO) and membrane osmometry and gel permeation chromotography, respectively. These polymers are prepared from ethylenically unsaturated hydrocarbons including cyclic, alicyclic and acyclic, containing from 2 to 30 carbons, e.g. 2 to 18 carbons.

Such V.I. improving polymers include oil-soluble polymers of isobutylene. Such polyisobutylenes are readily obtained in a known manner as by following the procedure of U.S. Pat. No. 2,084,501 wherein the isoolefin, e.g. isobutylene, is polymerized in the presence of a suitable Friedel-Crafts catalyst, e.g. boron fluoride, aluminum chloride, etc. at temperatures substantially below 0° C. such as at −40° C. Such polyisobutylenes can also be polymerized with a higher straight chain alpha olefin, preferably of 6 to 20 carbon atoms as taught in U.S. Pat. No. 2,534,095 where said copolymer contains from about 75 to about 99% by volume of isobutylene and about 1 to about 25% by volume of a higher normal alpha olefin of 6 to 20 carbon atoms.

Examples of other polymeric viscosity index modifier systems include copolymers of ethylene and $C_3$–$C_{18}$ monoolefins as described in Canadian Patent No. 934,743; copolymers of ethylene, $C_3$–$C_{12}$ monoolefins and $C_5$–$C_8$ diolefins as described in U.S. Pat. No. 3,598,738; mechanically degraded copolymers of ethylene, propylene and if desired a small amount, e.g. 0.5 to 12 wt. % of other $C_4$ to $C_{12}$ hydrocarbon mono- or diolefins as taught in U.S. Pat. No. 3,769,216 and U.K. Pat. No. 1,397,994; a polymer of conjugated diolefin of from 4 to 5 carbon atoms including butadiene, isoprene, 1,3-pentadiene and mixtures thereof as described in U.S. Pat. No. 3,312,621; random copolymers of butadiene and styrene which may be hydrogenated as described in U.S. Pat. Nos. 2,798,853 and 3,554,911; hydrogenated block copolymers of butadiene and styrene as described in U.S. Pat. No. 3,772,169; and random or block including hydrogenated (partially or fully) copolymers of butadiene and isoprene with up to 25 mol percent of a $C_8$–$C_{20}$ monovinyl aromatic compound, e.g. styrene as described in U.S. Pat. No. 3,795,615 (see also Belgium Pat. No. 759,713); etc.

Particularly preferred for haze-removal treatment according to this invention are ethylene copolymers of from about 2 to about 98, preferably 30 to 80, optimally 38 to 70 wt. % of ethylene with the balance being one or more $C_3$ to $C_{30}$ alpha olefins, preferably propylene, which have a degree of crystallinity of less than 25 wt. % as determined by X-ray and differential scanning calorimetry. Terpolymers containing ethylene, e.g. ethylene-propylene-ethylidene norbornene, are also contemplated to be used herein. The amount of the third monomer (preferably a $C_5$ to $C_{15}$ non-conjugated diolefin) ranges from about 0.5 to 20 mole percent, preferably about 1 to about 7 mole percent, based on the total amount of ethylene and alpha olefin present. These ethylene copolymers, which phrase is meant to include terpolymers, tetrapolymers, etc., may be readily prepared using soluble Ziegler-Natta catalyst compositions which are well known in the art. For reviews of the literature and patent art see: "Polyolefin Elastomers Based on Ethylene and Propylene", by F. P. Baldwin and G. VerStrate in Rubber Chem. & Tech. Vol. 45, No. 3, 709–881 (1972) and "Polymer Chemistry of Synthetic Elastomers", edited by Kennedy and Tornqvist, Interscience, N.Y. 1969.

Examples of the above-noted alpha monoolefins include propylene, 1-butene, 1-pentene, 1-hexene, 1-heptene, 1-decene, 1-dodecene, etc.

Representative non-limiting examples of non-conjungated diolefins include:

A. Straight chain acyclic dienes such as: 1,4-hexadiene; 1,5-heptadiene, 1,6-octadiene.

B. Branched chain acyclic dienes such as: 5-methyl-1,4-hexadiene; 3,7-dimethyl-1,6-octadiene; 3,7-dimethyl-1,7-octadiene; and the mixed isomers of dihydromyrcene and dihydroocimene.

C. Single ring alicyclic dienes such as: 1,4-cyclohexadiene; 1,5-cyclo-octadiene; 1,5-cyclododecadiene; 4-vinylcyclohexene; 1-allyl-4-isopropylidene cyclohexane; 3-allylcyclopentene; 4-allylcyclohexene and 1-isopropenyl-4-(4-butenyl) cyclohexane.

D. Multi-single ring alicyclic dienes such as: 4,4'-dicyclopentenyl and 4,4'-dicyclohexenyl dienes.

E. Multi-ring alicyclic fused and bridged ring dienes such as tetrahydroindene; methyl tetrahydroindene; dicyclopentadiene; bicyclo (2,2,1) hepta-2,5-diene, alkenyl, alkylidene, cycloalkenyl and cycloalkylidene norbornenes such as: 5-methylene-2-norbornene; 5-ethylidene-2-norbornene; 5-methylene-6-methyl-2-norbornene; 5-methylene-6,6-dimethyl-2-norbornene; 5-propenyl-2-norbornene; 5-(3-cyclopentenyl)-2-norbornene; 5-cyclohexylidene-2-norbornene; norbornadiene; etc.

In general, the catalyst compositions used to prepare these copolymers comprise a principal catalyst consisting of a transition metal compound from Groups IVb, Vb and VIb of the Periodic Table of the Elements, particularly compounds of titanium and vanadium, and organometallic reducing compounds from Groups IIa, IIb and IIIa, particularly organoaluminum compounds which are designated as cocatalysts. Preferred principal catalysts of vanadium have the general formula $VO_2X$, wherein z has a value of 0 or 1 and t has a value of 2 to 4. X is independently selected from the group consisting of halogens having an atomic number equal to or greater than 17, e.g. acetylacetonates, haloacetylacetonates, alkoxides and haloalkoxides. Non-limiting examples are: $VOCl_3$; $VO(AcAc)_2$; $VOCl_2(OBu)$; $V(AcAc)_3$; and $VOCl_2(AcAc)$ where Bu is n-butyl or isobutyl and (AcAc) is an acetylacetonate.

Preferred cocatalysts have the general formula $AlR'_mX'_n$ wherein R' is a monovalent hydrocarbon radical selected from the group consisting of $C_1$ to $C_{12}$ alkyl, alkylaryl, arylalkyl and cycloalkyl radicals, X' is a halogen having an atomic number equal to or greater than 17, m is a number from 1 to 3 and the sum of m and n is equal to 3. Non-limiting examples of useful cocatalysts are: $Al(Et)_3$; $Al(IsoBu)_3$; $Et_2AlCl$; $EtAlCl_2$ and $Et_3Al_2Cl_3$.

Syntheses of the copolymers, which may be conducted in batch, staged or continuous reactors, are preferably run in the presence of a purified solvent such as hexane which has been percolated through LINDE 3A catalyst and in the absence of moisture, air or oxygen and catalyst poisons. An atmosphere of oxygen-free nitrogen is preferably maintained above the reactants. Monomers, principal catalyst and cocatalyst are fed to the reactor supplied with means for withdrawing the heat of reaction and maintained under controlled agitation for a time, temperature and pressure sufficient to complete the reaction. Chain propagation retarders or stoppers, such as hydrogen may be fed continuously or intermittently to the reactor for the purpose of controlling the molecular weight within the desired limits and the degree of crystallinity known to be optimum for the end product.

Suitable times of reaction will generally be in the range from 1 to 300 minutes, temperatures will usually be in the range of −40° C. to 100° C. preferably 10° C. to 80° C., most preferably 20° C. to 60° C. and pressures from atmospheric to 160 psig are generally used. Monomer feed to the reactor per 100 parts by weight of solvent may be in the range of: ethylene, 2 to 20 parts by weight; $C_3$ to $C_{30}$ α-olefin, 4 to 20 parts by weight; and, if used, non-conjugated diene 0.1 to 10 parts by weight.

Principal catalyst, $VOCl_3$ for example, prediluted with solvents is fed to the reactor so as to provide a concentration in the range of 0.1 to 5.0 millimoles per liter. Cocatalyst, for example $Et_3Al_2Cl_3$ is at the same time fed to the reactor in an amount equal to from 2.0 to 20.0 moles of cocatalyst per mole of principal catalyst.

In general, polymers having a narrow range of molecular weight may be obtained by a choice of synthesis conditions such as choice of principal catalyst and cocatalyst combination and addition of hydrogen during the synthesis. Post synthesis treatment such as extrusion at elevated temperature and under high shear through small orifices, mastication under elevated temperatures, thermal degradation, fractional precipitation from solution, etc. may also be used to obtain narrow ranges of desired molecular weights and to break down higher molecular weight polymer to different molecular weight grades for V.I. use.

Molecular weight may be further regulated by choice of solvent, principal catalyst concentration, temperature, and the nature and amount of the cocatalyst, e.g. aluminum alkyl cocatalyst concentration.

Conventional procedures, well known in the art may be used for recovery of the polymer from the reaction mixture leaving the reactor. The polymer "cement" issuing from the reactor may be quenched with a lower alcohol such as methanol or isopropanol. A chelating agent can be added to solubilize the catalyst residues, and the polymer recovered as an aqueous slurry by steam stripping. The resulting wet crumb may be purified by filtration, and then dried at a moderately elevated temperature under vacuum.

THE CHELATING AGENT

Useful compounds to solubilize the metal containing haze component are oil soluble compounds of 5 to 50, preferably 10 to 40 carbon atoms, having a nitrogen or an —OH group separated by two or three carbon atoms from either an oxygen atom, a nitrogen atom or a hydroxy group. Examples of such compounds and structures include:

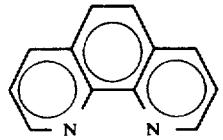

O—phenanthroline,

-continued

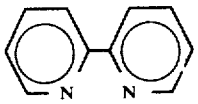

2,2'-dipyridyl,

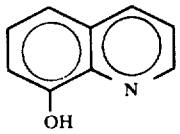

8-hydroxyquinoline,

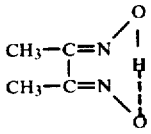

glyoxime,

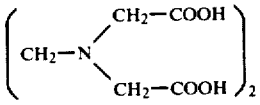

ethylene diamine tetraacetic acid,

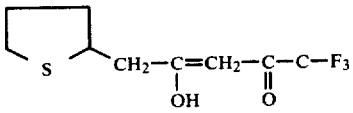

enol form of thiophene trifluoroacetylacetone,

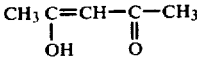

enol form of acetylacetone,

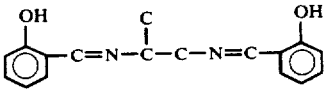

salicylaldimine, and

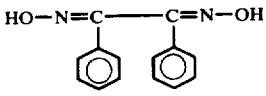

diphenylglyoxime,

An especially preferred class of chelating agents are oil-soluble spiro-(cyclo-alkane) analogues of oxazolidines, preferably substituted in the 2-position. These oil-soluble additives of the invention can be further defined as a spiro-(cycloalkane-1,2'-(4',4' disubstituted)-oxazolidine-1',3') and characterized generally by the formula:

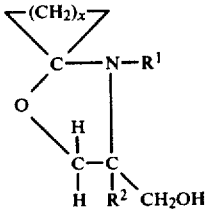

wherein: x is an integer of from 4 to 11; $R^1$ is hydrogen, methyl or ethyl; and $R^2$ is hydrogen; methyl or ethyl. These compounds are obtained from the reaction of 1 mole of a ketone per mole of an aminoalkanol (includes both the monool and diol) containing from 4 to 7 carbons and preferably according to the formula:

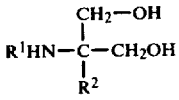

wherein $R^1$ and $R^2$ are the same as earlier defined. Representative compounds illustrative of said formula include: 2-amino-1,3-propanediol; 2-amino-2-methyl-1,3-propanediol; and 2-(methylamino)-1,3-propanediol.

This reaction can be carried out according to the general procedures described by M. Senkus in the Journal of the American Chemical Society, 67, 1515 (1945) by E. D. Bergmann, Chemical Reviews, 53, 309 (1953) and E. M. Hancock et al. JACS, 66, 1747 (1944). It is believed the reaction occurs as follows:

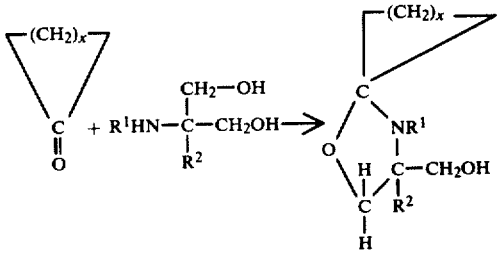

wherein x is 4 to 11, while $R^1$ and $R^2$ are the same as earlier defined.

The reaction is readily carried out by condensation and cyclization in a solvent such as toluene or benzene at a temperature of about 80° C. to 200° C., preferably 100° C. to 160° C., for a period until the water of condensation is removed. Excess ketone may be used to drive the reaction to completion and can then be removed with the solvent by vacuum distillation.

HAZE TREATING CONDITIONS

This invention has particular utility when the hazing substance is a metal salt and said hazing substance has a particle size of from about 0.01 microns to about 15 microns. It is preferred to treat the hydrocarbon solvent, e.g. oil, containing the metal-containing hazing substance, e.g. a metal salt of a carboxylic acid such as calcium stearate, by introducing the chelating compound within the range of from about 0.1 to about 2.5 mole equivalents, preferably about 1 equivalent of chelating agent per equivalent of metal extant in said hazing substance. These treatment ranges can be adjusted to reflect the relative oil solubility of the hazing substance, e.g., a semisoluble hazing substance would be treated at a level less than an equivalent basis.

Metals which may contribute to haze include the alkaline earth metals, zinc, sodium, potassium, aluminum, vanadium, chromium, iron, manganese, cobalt, nickel, cadmium, lead, bismuth and antimony. Such metals which develop the haze can come from a variety of sources during the manufacture of the ethylene copolymer including the catalyst, impurities developed during mechanical processing of the ethylene copolymer and from dispersants used to maintain the polymer in dispersion or suspension while stored during subsequent processing or awaiting shipping. In the following examples, an ethylene-propylene copolymer was used containing calcium stearate which was used as a processing aid. The calcium stearate was present in a particle size of less than about 15 microns as it could not be removed by conventional filtration. It is generally possible to filter out those haze contributing particles which have a particle size greater than about 15 microns. At lesser sizes, it has been found that the haze producing impurity is difficult if not impossible to filter so that it is optimally treated according to this invention.

It has been found useful to carry out the process by first treating the polymer containing oil solution with the chelating agent in an amount within the range of from about 0.1 to about 2.5 moles of chelating agent per mole of metal. Preferably the oil-soluble chelating agent is added in an amount of about 1 mole per mole of metal. A common way to exercise the process is to convert to a weight basis and to add the chelating agent to the polymer-oil solution in an amount usually of less than about 1 wt. % based upon the total weight of the polymer-oil composition, and usually from about 0.005 to 1.0, e.g. 0.01 to 0.5, preferably 0.1 to about 0.5 wt. %.

The treatment of the haze containing ethylene copolymer oil composition is carried out at a temperature of about room temperature to about 250° C., preferably from about 50° to about 160° C. and for a time period of about 0.1 hour up to about 20 hours, preferably from 0.5 to about 2 hours. There is no need to carry out the treatment under pressure. This makes it possible to conduct the process of the invention in an open vessel in the presence of air or inert gas wherein the amount of haze treating agent, i.e. the chelating agent is added with stirring.

In a preferred method according to the invention, haze is prevented in an oil composition comprising the lubricating oil solvent, generally from 0.1 to 40 wt. %, e.g. an additive concentrate of 3 to 20 wt. %, or a lubricating oil composition with 0.1 to 3.0 wt. %, of an ethylene-propylene copolymer viscosity index improver having a molecular weight ($\overline{M}_n$) of 10,000 to 500,000 and a hazing substance containing calcium stearate of particle diameter ranging from about 0.01 microns to about 15 microns by the step of treating said composition with said chelating compound in an amount of from about 0.01 wt. % to 1.0 wt. % at a temperature within the range of about room temperature to about 250° C. and for a period from about 0.1 hour to about 20 hours, e.g. for ½ hour at 80°–160° C. All of said weight percents being based on the total weight of the oil composition.

As earlier noted the oil additive concentrate or lubricating oil compositions are contemplated to be admixed with other additives, including dyes; pour point depressants, anti-wear agents, such as tricresyl phosphate, zinc dihydrocarbyl dithiophosphate; antioxidants such as N-phenyl, alpha-naphthyl amine, tertoctylphenol sulfide, 4,4'-methylene bis(2,6-ditert-butylphenol); other viscosity index improvers such as polymethacrylates, alkyl fumarate-vinyl acetate copolymers and the like; as well as ashless dispersants; detergents; etc.

The invention will be further understood by reference to the following examples which include preferred embodiments of the invention.

EXAMPLE 1

Spiro-(cyclohexane-1,2'-(4'-methylol-4'-ethyl)oxazolidine-1',3') was prepared by mixing 2 moles (196 g) of cyclohexanone (one mole excess) and 1 mole (119 g) of 2-amino-2-ethyl-1,3,-propane diol (AEPD) in a flask having a Dean-Starke trap and refluxed for two hours at about 120° C., after which 200 cc of toluene was added and the mixture was heated at 137° C. until 16 ml of water were collected, followed by vacuum distillation to remove the toluene solvent and excess cyclohexanone.

The resulting product was clear amber oil and analyzed as 66.2 wt. % C, 10.8 wt. % H and 7.2 wt. % N.

EXAMPLE 2

100 grams of an oil concentrate of an ethylene-propylene copolymer, consisting of about 12% by weight of said copolymer having an ethylene content of 46 wt. %, a propylene content of about 54 wt. %, a $\overline{M}_n$ of approximately 60,000, an $\overline{M}_w/\overline{M}_n$ of about 2.9, dissolved in 88 wt. % of Solvent 100 Neutral mineral lubricating oil, was heated to about 160° C. whereupon there was added 0.1 grams of the spiro-(cyclohexane-1,2'-(4'-methylol-4-ethyl) oxazoline-1', 3') product of Example 1. After ten minutes of stirring, the sample was cooled to room temperature. The original sample of the oil concentrate of ethylene-propylene copolymer was hazy to the eye whereas the concentrate treated with the oxazolidine of Example 1 was clear to the eye. The original and treated samples were placed in a nephelometer to measure the change in haze and readings from the instrument (Nepho-colorimeter Model 9 sold by the Coleman Instrument Corporation of Maywood, Illinois) gave a reading of 36 on the untreated sample whereas the treated sample has a reading of about 23.

EXAMPLE 3

Example 2 was repeated but instead of the 0.1 wt. % oxazolidine there was used 0.2 wt. % of duPont Metal Deactivator #2 which was a concentrate in about 50 wt. % oil of about 50 wt. % of an adduct of one mole of propylene diamine with two moles of salicylaldehyde, said compound having the structure:

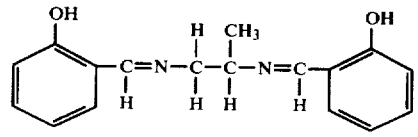

The resulting oil solution was visually clear after the addition of the Metal Deactivator #2, although it was visually hazy before said addition.

What is claimed is:

1. A process of inhibiting haze in an oil composition comprising a major amount of lubricating oil and 5 to 30 wt. % of copolymer V.I. improver comprising 30 to 80 wt. % ethylene and $C_3$ to $C_{30}$ alpha olefin, having a number average molecular weight of about 10,000 to 200,000 having an insoluble metal contaminant which causes haze in said oil, said process comprising adding as a haze inhibitor about 0.005 to 1 wt. % of an oil soluble metal chelating compound which is a spiro-(cycloalkane-oxazolidine) characterized by the formula:

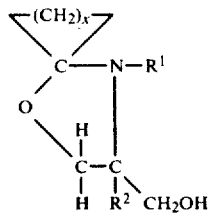

wherein: x is an integer of from 4 to 11; $R^1$ is hydrogen, methyl or ethyl; and $R^2$ is hydrogen, methyl or ethyl.

2. A process according to claim 1, wherein said ethylene copolymer comprises about 30 to 80 wt. % ethylene and about 20 to 70 wt. % propylene, said polymer being formed by a Ziegler-Natta polymerization, said polymer having a $M_n$ in the range from about 20,000 to 100,000 and $M_w/M_n$ ratio of less than 10.

3. A process according to claim 2, wherein said metal contaminant is present in a haze forming amount but less than 1 wt. %, based on the total weight of said composition, and is an oil insoluble, haze forming material resulting from the manufacture of said polymer, which material is a metal salt of an organic acid wherein said metal is selected from the class consisting of alkaline earth metal, zinc, sodium, potassium, aluminum, vanadium, chromium, iron, manganese cobalt, nickel, cadmium, lead, bismuth and antimony.

4. A process according to claim 3, wherein said spiro-(cycloalkane-oxazolidine) is obtained from the equimolar reaction of an amino-alkanol having two hydroxy groups and 4 to 7 carbons with a cycloalkanone having from 5 to 12 carbons.

5. A process according to claim 4, wherein said spiro-(cycloalkane-oxazolidine) is spiro-(cyclohexane-1,2'-(4'-methylol-4'ethyl)-oxazolidine-1',3') present in an amount ranging from 0.01 to 1 weight percent based on the total weight of said composition.

* * * * *